US005174462A

United States Patent [19]

Hames

[11] Patent Number: 5,174,462

[45] Date of Patent: Dec. 29, 1992

[54] ADSORBENT NEUTRALIZER

[75] Inventor: David B. Hames, Blaine, Minn.

[73] Assignee: John M. Norton, Bloomington, Minn. ; a part interest

[21] Appl. No.: 778,285

[22] Filed: Oct. 17, 1991

[51] Int. Cl.[5] ..... B65D 25/10

[52] U.S. Cl. ..... 220/87.1; 220/522; 220/908

[58] Field of Search ..... 220/87.1, 522, 402, 220/908, 909; 422/122; 383/117

[56] References Cited

U.S. PATENT DOCUMENTS

| | | | |
|---|---|---|---|
| 143,822 | 10/1873 | Graves | 220/402 |
| 265,609 | 10/1882 | Johnston | 220/522 |
| 503,212 | 8/1893 | MacLeod | 220/87.1 |
| 1,231,553 | 7/1917 | Bach et al. | 220/87.1 |
| 1,327,397 | 1/1920 | Levin | 220/87.1 |
| 1,397,260 | 11/1921 | Trottier | 220/87.1 |
| 1,794,940 | 3/1931 | Zimmermann | 220/521 |
| 2,067,547 | 1/1937 | Schneider et al. | 220/87.1 |
| 2,411,430 | 11/1946 | Hodson | 220/87,1 |
| 2,802,590 | 8/1957 | Tupper | 220/87.1 |
| 3,772,712 | 11/1973 | Renn et al. | 4/484 |
| 3,881,408 | 5/1975 | Valor | 100/90 |
| 4,427,110 | 1/1984 | Shaw, Jr. | 220/87.1 |
| 4,980,132 | 12/1990 | Stinson et al. | 220/87.1 |
| 5,022,553 | 6/1991 | Pontius | 220/410 |
| 5,033,520 | 7/1991 | Kuehmichel | 220/86.1 |
| 5,065,886 | 11/1991 | Sher | 220/87.1 |

OTHER PUBLICATIONS

NSA literature on Refrigerator/Freezer Deodorizer, undated, unpaginated, one page.

*Primary Examiner*—Allan N. Shoap
*Assistant Examiner*—S. Castellano
*Attorney, Agent, or Firm*—Palmatier, Sjoquist & Helget

[57] ABSTRACT

An adsorbent neutralizer for absorbing, without disguising, odorous gases from soiled matter in a relatively large container having a closable opening at least the size of a hand. The adsorbent neutralizer is contained in a perforated receptacle and may be engaged relative to the container via adhesive strips or via a perforated holder on the container. The container may be a plastic trash bag having the absorbent neutralizer on an inside surface.

7 Claims, 4 Drawing Sheets

ADSORBENT NEUTRALIZER

BACKGROUND OF THE INVENTION

The present invention relates to an adsorbant neutralizer and, more particularly, to such a neutralizer in combination with a relatively large soiled matter container having a closable opening at least the size of a hand.

The twentieth century consumer is bombarded on a daily basis with advertising relating to deodorants. The advertising medians may attempt to shame or humiliate or utilize peer pressure to make the consumer believe that he or she must pop open a certain "fresh" air container for the party, must apply a particular underarm deodorant, must throw in this fabric softener to leave the clothes smelling correctly, or must wipe the table tops with that lemon fresh chemical to impress the mother-in-law. Such deodorants only mask or disguise the underlying odors.

SUMMARY OF THE INVENTION

A feature of the present invention is an adsorbent neutralizer for absorbing odorous gases in a relatively large soiled matter container having a closable opening at least the size of a hand for insertion of the soiled matter.

Another feature is the provision in such an adsorbent neutralizer, of a receptacle for holding the adsorbent and which includes a perforated portion for permitting gas flow to the absorbent.

Another feature is the provision in such an adsorbent neutralizer, of the neutralizer being removably engagable with the underside of the lid of such a container.

Another feature is the provision in such an adsorbent neutralizer, of the neutralizer having exposable adhesive means and being attached to an object such as the lid of such a soiled matter container.

Another feature is the provision in such an adsorbent neutralizer, of the lid having an inner holder for the neutralizer and wherein the holder includes an access at least the size of a hand for inserting and removing the neutralizer.

Another feature is the provision in such an adsorbent neutralizer, of the neutralizer including activated carbon.

Another feature is the provision of an adsorbent neutralizer on the inside of a plastic trash bag.

An advantage of the present invention is that odors are absorbed or neutralized instead of masked.

Another advantage is that the adsorbent neutralizer is easily accessible to the hand for being replaced.

Another advantage is that the adsorbent neutralizer is contained at an effective location even when its respective container is swung about or moved.

Another advantage is that the adsorbent neutralizer is nontoxic.

Another advantage is that a given amount of adsorbent neutralizer lasts longer than the same amount of most commonly used deodorants.

Another advantage is that the adsorbent neutralizer functions only in the presence of gases which it may absorb. In contrast, a deodorant may continually emit its scent.

Another advantage is that the adsorbent neutralizer is biodegradable. After used, it is simply thrown away in the soiled matter container.

Another advantage is that the adsorbent neutralizer is inexpensive.

DETAILED DESCRIPTION OF THE PREFERRED EMBODIMENTS

Figure 1:
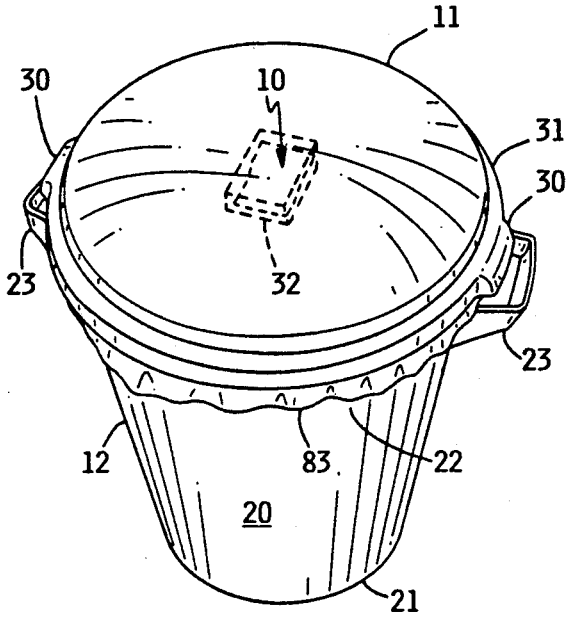
FIG. 1 is a perspective view of a trash container with the present adsorbent neutralizer shown in phantom in a holder on the underside of the lid of the trash container.

As shown in FIG. 1, the present adsorbent neutralizer is indicated in general by the reference numeral 10. It is preferably disposed on the underside of a lid 11 of a trash container 12 to neutralize or absorb odorous gases from soiled matter in the container 12.

As shown in FIG. 1, the plastic relatively rigid trash container 12 includes a continuous sidewall 20 extending integrally upwardly from a lower closed end or floor 21. Opposite of the floor 21, the sidewall 20 includes an upper edge portion 22 which forms an open end. The open end is closable by the lid 11 which sealably engages the upper edge portion 22 to close the container 12. The open end formed by the upper edge portion 22 is at least the size of a hand for the insertion and removal of soiled matter. The container 12 further includes a pair of integral handles 23. The trash container 12 may be a metal or aluminum trash can.

Figure 2A:
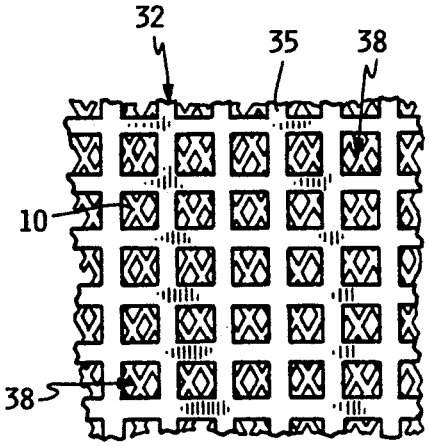
FIG. 2A is an enlarged detail view of a portion of the holder at lines 2A—2A of FIG. 2.
Figure 2:
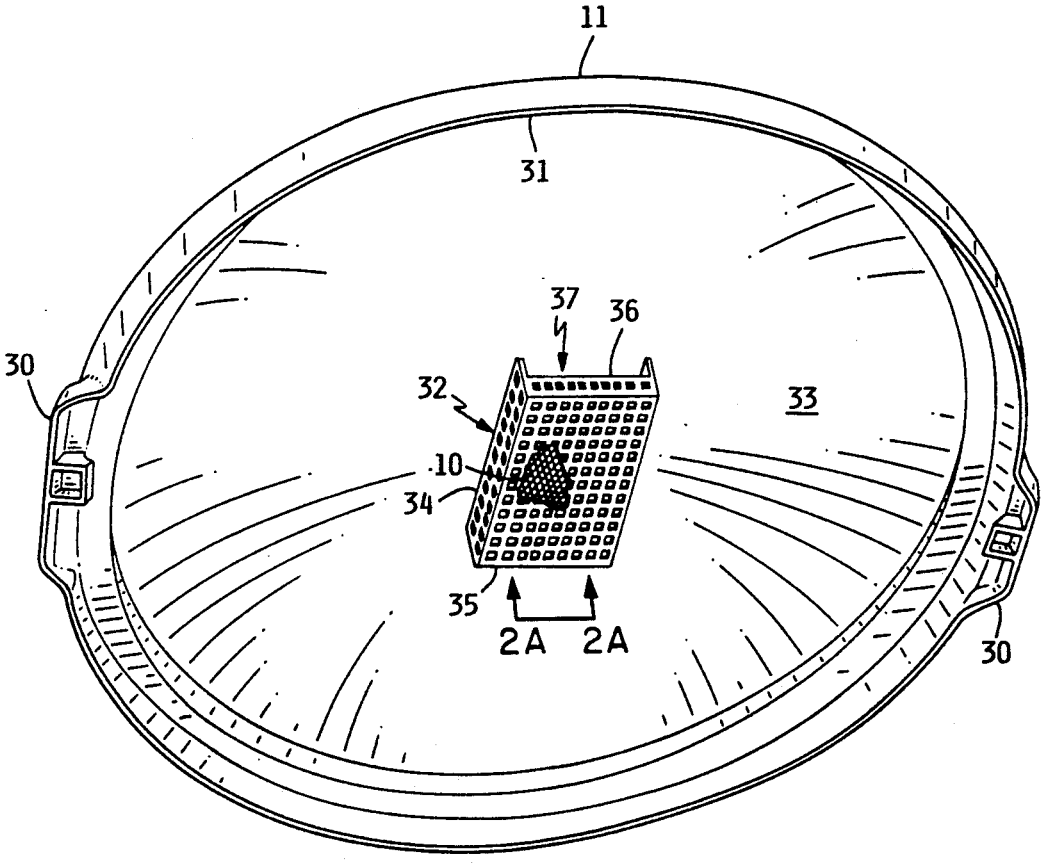
FIG. 2 is a detail, perspective view of the adsorbent neutralizer in the holder on the underside of the lid of the trash container of FIG. 1.
Figure 3:
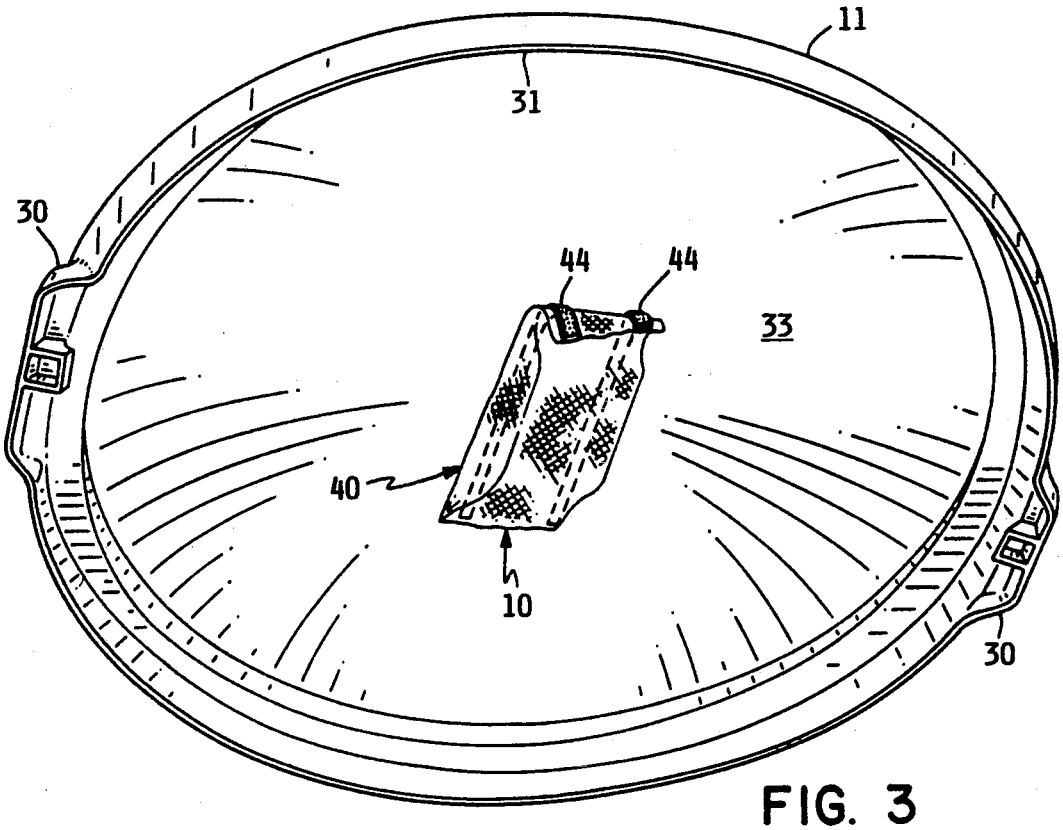
FIG. 3 is a perspective detail view of the trash container of FIG. 1 with an adhesively attached adsorbent neutralizer.
Figure 4:
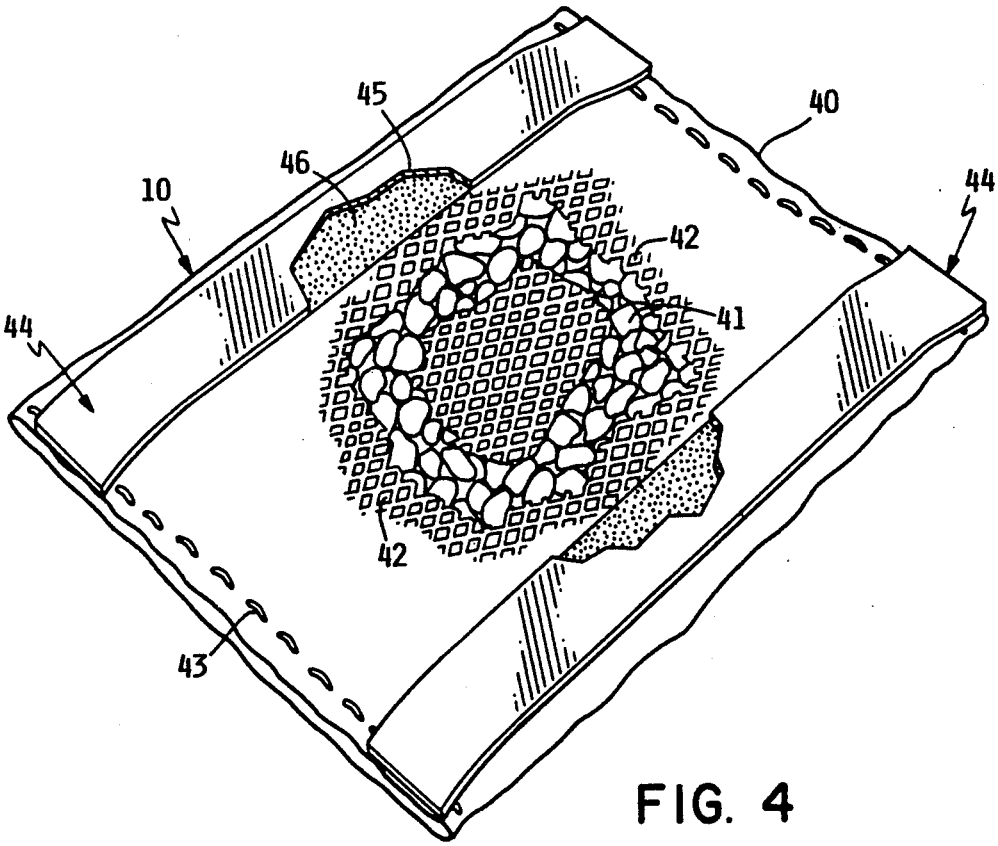
FIG. 4 is a detail view of the adhesively attached adsorbent neutralizer of FIG. 3.

As shown in FIG. 2, the lid 11 includes a pair of handles 30, a rim 31 for engaging the upper edge portion 22, and a holder or receptacle 32 for holding the adsorbent neutralizer 10. The holder 32 is disposed centrally on an inner surface or underside 33 of the lid 11. The holder 32 extends downwardly into the container 12 and is preferably formed integrally with the lid 11 as the container 12 is preferably formed of plastic. The holder 32 includes a pair of perforated side supports 34, a perforated bottom 35, and a pair of perforated retaining walls 36. The retaining walls 36 are spaced from the underside 33 of the lid 11 to form a hand-sized opening or access 37 to permit the insertion or removal of the adsorbent neutralizer 10 to or from the holder 32. The distance between the supports 34 and the distance between the retaining walls 36 is approximately equal to the corresponding width and length of the adsorbent neutralizer 10 to minimize movement of the adsorbent neutralizer 10 relative to the lid 11 or container 12 when such is lifted or moved. As shown in FIG. 2A, the holder 32 includes perforations 38 to permit gas flow to the adsorbent neutralizer 10.

The adsorbent neutralizer 10 preferably includes a closed receptacle or bag 40 for holding activated carbon granules 41 therein. The bag 40 is preferably formed of a gauze or gauze-like material having perforations 42 to permit gas flow to the activated carbon granules 41. The size of the perforations 42 is less than the size of the activated carbon granules 41 to retain the granules 41 in the bag 40. The bag 40 includes stitching 43 along opposite sides to reinforce the bag 40. The bag 40 further preferably includes a pair of adhesive strips 44 affixed thereto. Each of the adhesive strips 44 includes a removable backing strip 45 to expose an adhesive 46 for adhering or securing the bag 40 to the underside 33 of the lid 11 of the trash container 12. The bag 40 is preferably placed centrally or at the apex of the lid 11, but it should be noted that the bag 40 may be secured to the inside upper edge portion of the trash container 12. The adhesive strips 44 run to approximately the edges of the bag 40 to adequately support the bag 40 and its granules 41, yet are sufficiently narrow to maximize exposure of the perforations 42. The adhesive strips 44 are typically not utilized when the lid 11 includes the holder 32, but may be utilized to engage either the floor 35 or the underside 33, when in the holder 32.

It should be noted that the adhesive 46 on the adhesive strips 44 is less tacky or of a less adhesive strength than the adhesive utilized to secure the adhesive strips 44 to the gauze bag 40 so that the adhesive strips 44 disengage from the lid 11, or other container, before the strips 44 disengage from the gauze bag 40.

Figure 5:
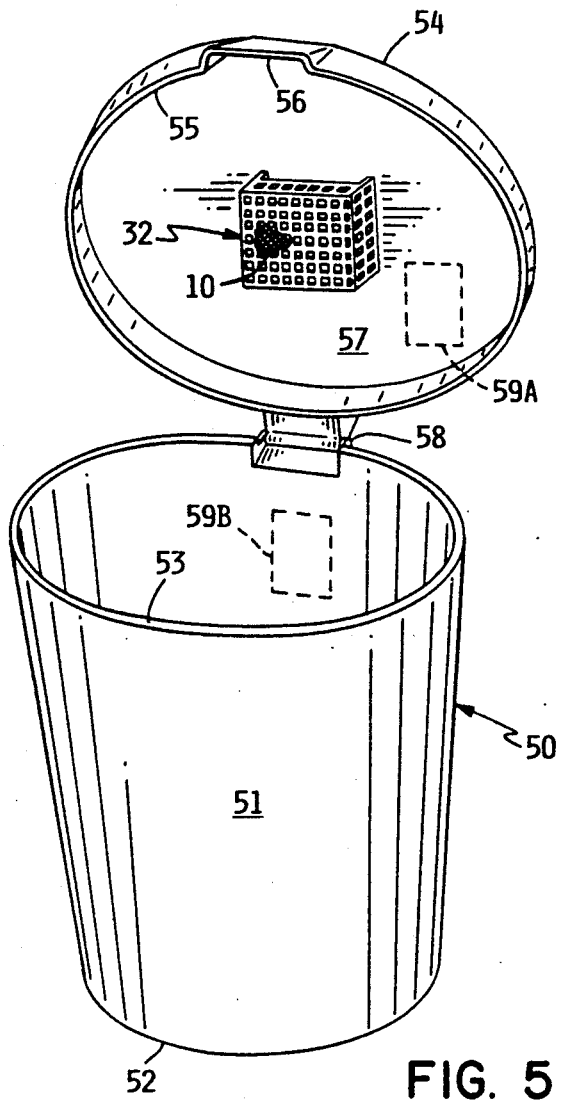
FIG. 5 is a perspective view of a soiled matter container having a hinged, swingable lid with a holder for the adsorbent neutralizer on the underside of the lid.

As shown in FIG. 5, a trash container or diaper pail 50 includes a continuous sidewall 51 with an integral floor or lower end 52. The sidewall 51 includes an upper edge portion 53 which forms a closable opening at least hand-sized for the insertion and removal of relatively large objects such as diapers. The upper edge portion 53 is sealably engaged by a lid 54 having a rim 55. The lid 54 includes a handle 56. The lid 54 includes an underside 57 from which the holder 32 integrally extends. The holder 32 includes the adsorbent neutralizer 10. The lid 54 is hingedly connected to the upper edge portion 53 via a hinge 58 such that the lid 54 is swingably engagable with the upper edge portion 53. If desired, the adsorbent neutralizer 10 may be attached directly to the underside 57, either centrally or offset from the center, via the adhesive strips 44 as shown in phantom by reference numeral 59A or directly to the inside of the sidewall 51 as shown in phantom by reference numeral 59B.

Figure 6:
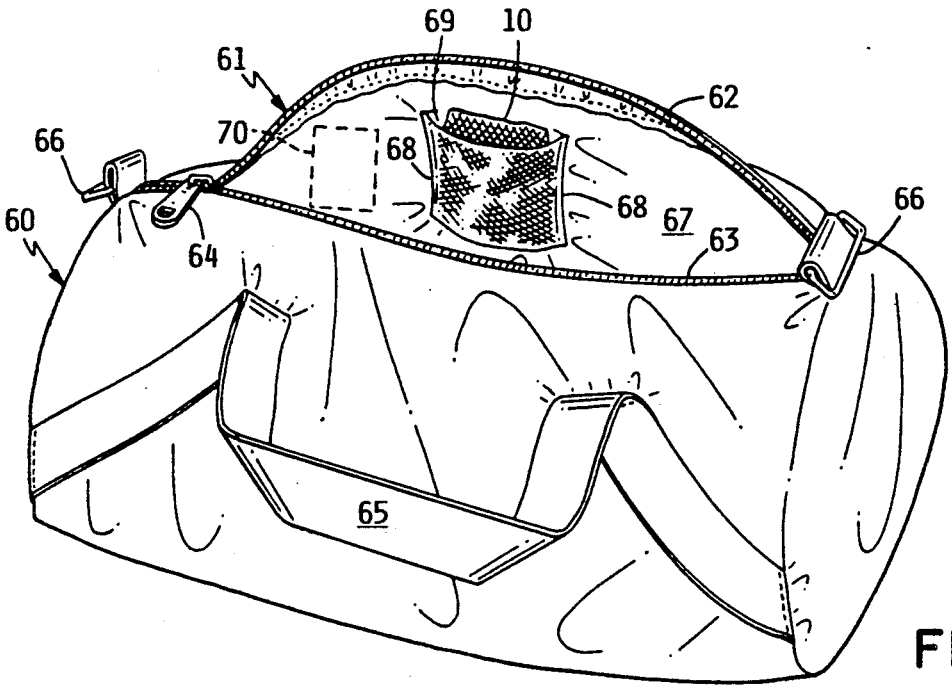
FIG. 6 is a perspective view of a flexible container with a zipper and shows an inner, integral holder for the adsorbent neutralizer.

As shown in FIG. 6, an athletic bag 60 includes a zipper 61 having a pair of rows of teeth 62, 63 which are interlockable and separable by a sliding tab 64 to open and close the bag 60. The bag 60 is typically formed of a flexible fabric or fabric like material. On its exterior, the bag 60 includes a pair of handles 65 and a pair of buckles 66 for engaging a shoulder strap. In its interior, an inner side 67 of the bag 60 includes an integrally woven perforated pocket or holder 68 for holding the adsorbent neutralizer 10. The perforated pocket forms at its upper portion an opening 69 which is at least the size of a a hand to insert and remove the adsorbent neutralizer 10. The pocket 68 is preferably approximately the size of the adsorbent neutralizer 10 such that the adhesive strips 44 are typically not used when the adsorbent neutralizer 10 is in the pocket. However, if desired, the adhesive strips 44 may be used to attach the neutralizer 10 to the inner side 67 outside of the pocket 68 as shown in phantom by reference numeral 70.

Figure 7:
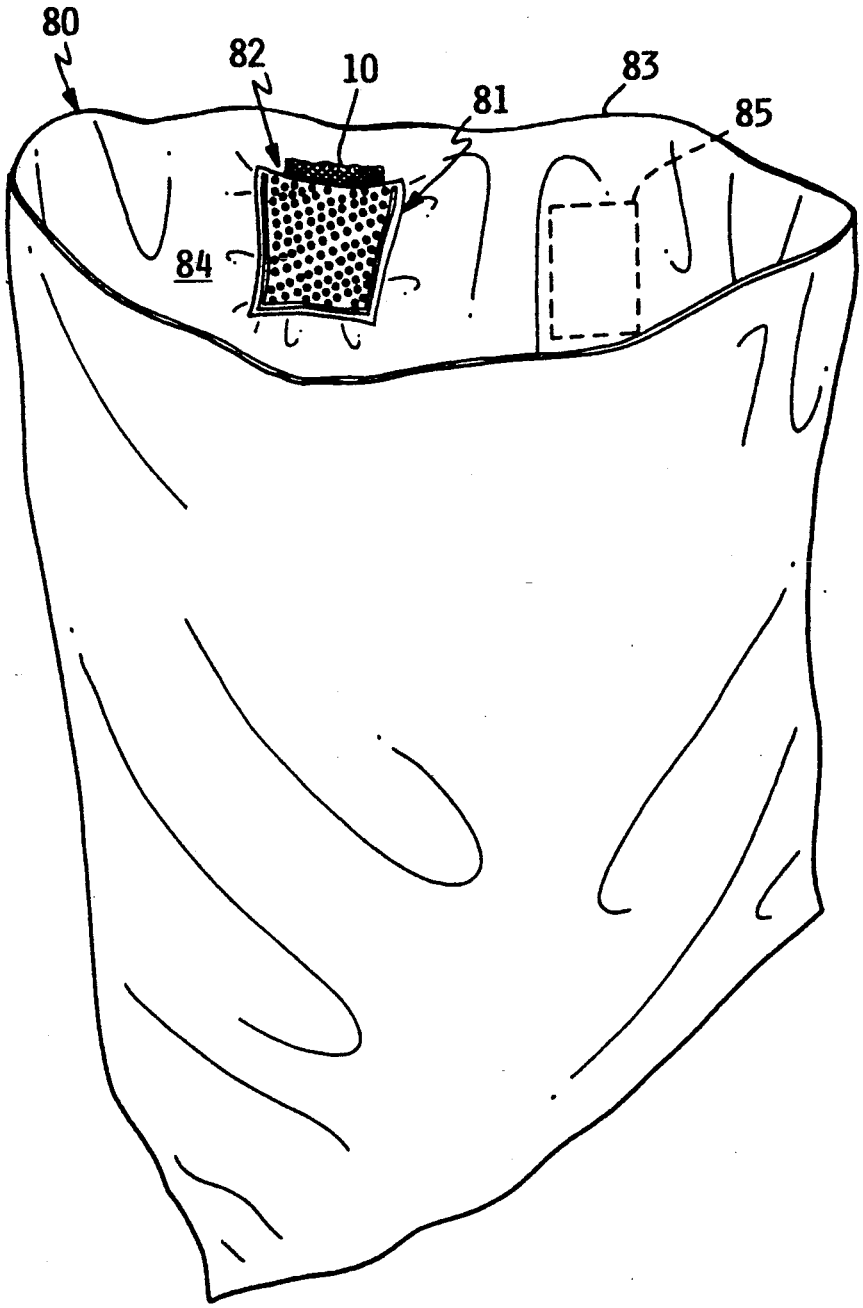
FIG. 7 is a perspective view of a plastic bag container having an inner, integral holder for the adsorbent neutralizer.

As shown in FIG. 7, a plastic nonporous garbage bag or flexible container 80 includes an integral, perforated pocket or holder 81 for holding the adsorbent neutralizer 10. The pocket 81 forms at its upper portion an opening 82 which is at least the size of a hand for insertion and removal of the neutralizer 10. The pocket 80 is approximately the size of the neutralizer 10 to limit movement of the neutralizer 10 therein. The plastic bag 80 includes an upper edge portion 83 which forms another opening at least the size of a hand for insertion and removal of relatively large soiled objects. It should be noted that the pocket 81 is preferably spaced from the upper edge portion 83 such that the upper edge portion 83 may be pinched between the rim 31 and the upper edge portion 22 of the container 12. It should further be noted that the adhesive strips 44 may be utilized to secure the adsorbent neutralizer 10 directly to an inner surface 84 as shown in phantom by reference numeral 85.

In operation, typically before soiled matter is placed into any one of the containers 12, 50, 60, or 80, the adsorbent neutralizer 10 is placed in its respective container via the respective holder 32, 68, 81 or via the adhesive strips 44 or via both the holder and adhesive strips if desired. When soiled matter is placed in the respective containers and produces odorous gases, such gases are absorbed by the activated carbon granules 41 to neutralize such odors instead of masking such odors like a deodorant. The neutralizer 10 may be replaced after a certain period of time depending upon the amount of soiled matter in or passing through the respective containers.

It should be noted that it is believed that activated carbon is an adsorptive material, i.e. a material that assimilates gas, vapor or some dissolved matter by the surface of the solid material. In the present case, activated carbon powder, granules, or blocks are preferred. However, it should be noted that other adsorptive materials may be used, such as silica gel, unactivated carbon, zeolite, bentonite, or calcium carbonate. Furthermore, an enhancer such as KDF 55-D may be added to the adsorptive material to increase the effective life of the adsorptive material. KDF 55-D is available from KDF, 120 S. Washington St., P.O. Box 227, Constantine, Mich. 49042.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A nonvolatile adsorbent neutralizer for adsorbing odorous gases in combination with a relatively large soiled matter trash container having a closable opening at least the size of a hand for insertion of the solid matter, the trash container further including a lid and an interior, the lid having an inner surface a least partially defining the interior, the neutralizer disposed in the trash container, comprising:

a) nonvolatile adsorbent material for adsorbing the odorous gases;

b) a perforated bag receptacle formed of a fabric material for containing the adsorbent material and for permitting gas flow to the adsorbent material; and c) an engagement for engaging the perforated bag receptacle relative to the container, the engagement including adhesive on the perforated receptacle for adhering to the inner surface and for minimizing movement of the perforated bag receptacle relative to the container when the container is moved.

2. The neutralizer and trash container combination of claim 1, wherein the engagement further includes an inner surface portion extending from the inner surface and comprises a relatively rigid holder for holding the receptacle, the holder comprising a perforated portion for permitting gas flow therethrough and to the receptacle holding the adsorbent material.

3. The neutralizer and trash container combination of claim 2, wherein the holder is integral with the lid.

4. The neutralizer and trash container combination of claim 3, wherein the holder includes an access at least hand-sized for the insertion of a hand to remove the receptacle.

5. The neutralizer and trash container combination of claim 1, wherein the adsorbent material comprises activated carbon.

6. The neutralizer and trash container combination of claim 5, wherein the activated carbon comprises activated carbon granules.

7. A plastic, relatively rigid trash can in combination with an activated carbon neutralizer, the combination comprising:

a) the trash can, which comprises:
   1) a body with a sidewall integrally connected to a floor, the sidewall forming an upper open end at least the size of a hand; and
   2) a lid sealably engageable with the sidewall to close the open end and comprising a handle and an inner surface; and b) the activated carbon neutralizer, which comprises:
   1) nonvolatile activated carbon granules;
   2) a bag receptacle formed of a fabric material for holding the activated carbon granules, the receptacle comprising a perforated portion for permitting gas flow to the activated carbon granules; and
   3) an exposable adhesive fixed to the receptacle for connecting the receptacle to the trash can whereby the activated carbon granules neutralize without disguising odorous gases from the trash can.

* * * * *